US006231234B1

(12) United States Patent
Gebhardt

(10) Patent No.: US 6,231,234 B1
(45) Date of Patent: May 15, 2001

(54) ONE PIECE SNAP CLOSURE FOR A PLASTIC BAG

(75) Inventor: Terry D. Gebhardt, Longview, TX (US)

(73) Assignee: TC Manufacturing Co., Inc., Evanston, IL (US)

( * ) Notice: Subject to any disclaimer, the term of this patent is extended or adjusted under 35 U.S.C. 154(b) by 0 days.

(21) Appl. No.: 09/415,048

(22) Filed: Oct. 7, 1999

Related U.S. Application Data

(63) Continuation-in-part of application No. 09/078,175, filed on May 13, 1998, now abandoned.

(51) Int. Cl.[7] ..... B65D 33/24
(52) U.S. Cl. ..... 383/61; 383/90
(58) Field of Search ..... 383/89, 90, 61, 383/63; 24/30.5 R

(56) References Cited

U.S. PATENT DOCUMENTS

| | | | |
|---|---|---|---|
| 1,459,735 | 6/1923 | Kraft . | |
| 1,762,689 | 6/1930 | Kohn . | |
| 3,027,066 | 3/1962 | Vineberg | 383/81 |
| 3,707,271 | 12/1972 | Sanchez et al. . | |
| 4,296,529 | 10/1981 | Brown . | |
| 4,486,923 | 12/1984 | Briggs | 24/30.5 R |
| 4,514,882 | 5/1985 | Lavielle . | |
| 4,742,601 | 5/1988 | Furutsu . | |
| 4,811,465 | 3/1989 | Folkmar | 24/30.5 R |
| 4,866,818 | 9/1989 | Thompson . | |
| 4,871,264 | 10/1989 | Robbins, III | 383/78 |
| 4,887,335 | 12/1989 | Folkmar . | |
| 4,928,829 | 5/1990 | DiBernardo . | |
| 4,997,104 | 3/1991 | Pohl | 383/90 |
| 5,050,272 | 9/1991 | Robinson et al. . | |
| 5,054,168 | 10/1991 | Gandy et al. . | |
| 5,079,806 | 1/1992 | Allen . | |
| 5,109,576 | 5/1992 | Teekell et al. . | |
| 5,379,489 | 1/1995 | Delk et al. . | |
| 5,428,871 | 7/1995 | Iosif . | |
| 5,480,030 | 1/1996 | Sweeney et al. | 383/78 |
| 5,598,608 | 2/1997 | Naslund . | |
| 5,604,959 | 2/1997 | Bowen . | |
| 5,682,649 | 11/1997 | Lo | 24/30.5 R |
| 5,713,108 | 2/1998 | Solomon et al. . | |

FOREIGN PATENT DOCUMENTS

| | | | |
|---|---|---|---|
| 90167 | 12/1960 | (DK) | 383/81 |

*Primary Examiner*—Stephen P. Garbe
(74) *Attorney, Agent, or Firm*—Lee, Mann, Smith, McWilliams, Sweeney and Ohlson

(57) ABSTRACT

A plastic bag having a closure device attached thereto adjacent the opening and adapted to fold over the bag walls and hook to itself to seal the bag while allowing the opening to remain outside of the closure.

14 Claims, 2 Drawing Sheets

50
51
60
61
36
32
28
34
30
20a
20b
12

ONE PIECE SNAP CLOSURE FOR A PLASTIC BAG

PRIOR APPLICATION

This application is a continuation in part of application Ser. No. 09/078,175 filed on May 13, 1998 now abandoned.

BACKGROUND OF THE INVENTION

This invention relates generally to plastic bags and closures therefor. More particularly, the invention relates to closures for plastic bags designed for carrying food products and the like to maintain those products in useable condition.

This explanation will be directed rather specifically to plastic bags used for storing food products and other perishable items. However, it should be understood that the structures disclosed in this application would be useful for many other purposes and it is not intended that this application be limited to plastic bags for food products.

It is not uncommon after dinner is over for the cook to gather up the left-over food, put it in various plastic bag containers and then put them in the refrigerator for use at a later time. Generally, when doing this it is desirable to somehow close the plastic bag or seal it to maintain the food products in as fresh a condition as possible. Such things as metal ties have been used for this purpose. Clamps and other devices have also been used. All of these have the disadvantage that they are not attached to the bag itself so that they must be obtained from some other source and added to the bag. Furthermore, frequently, they are not satisfactory. There are numerous patents that have been issued in this area, for example, see U.S. Pat. No. 5,054,168 which discloses a horizontal clip closure, U.S. Pat. No. 4,928,829 which also discloses a horizontal clip closure, U.S. Pat. No. 4,866,818 which discloses a pinched clip designed to be snapped horizontally around the opening of the bag, U.S. Pat. No. 4,887,335 which discloses a horizontal clip for use in closing plastic bags and other patents which will be listed in the disclosure statement for this patent application. None of these devices perform the function of closing the bag opening in a satisfactory fashion, so that they easily close the opening and provide a suitable atmosphere for maintaining food products.

The disadvantage of these prior art devices, in general, is that they are horizontal closures, i.e., operate horizontally or parallel to the opening of the bag. These devices are also separate from the bag. Thus, they must be added to the bag before they can be made useful for closure purposes.

Another popular resealable bag is the zipper or profile bag, such as the bags manufactured by Dow Chemical under the registered trademark ZIPLOCK. Those bags contain a zipper or interlocking profiles at the mouth of the bag which permit the user to selectively open and reseal the bag many times.

The zipper bag is typically a plastic bag having a front wall and a back wall with opposing and corresponding interlocking profiles on the inner sides of each wall. The profiles are generally located at or very near the opening of the bag, with a lip of bag wall extending above the opening to aid the user in reopening the bag. Other variations of the zipper bag include a slide which is used to open and close the profiles. As the slide is drawn across the profiles, it opens the bag if drawn in one direction, and seals the bag if drawn in the other. The bags equipped with a slide typically do not have a lip extending above the profiles as such a lip would interfere with the slide. Further, the lip is not necessary to open the profiles since the slide performs that function. The slide also performs the function of aligning the profiles, thus reducing the frustration of the user in trying to align the profiles.

The profiles of a zipper bag generally run substantially the entire length of the opening such that when they are interlocked, they form a seal across the entire bag opening. While making an effective seal, these bags are not without their disadvantages.

Conventional recloseable deli bags, using the standard zipper or a slide, do not prevent the food or other products from coming in contact with the zipper profiles since the zipper profiles are located on the inside of the bag. This causes food or other substances to be raked off onto the profiles when items are placed in or removed from the bag. The food or other substances can become embedded in the profiles, therefore making them difficult or impossible to engage.

The snap closure as described in this present application is completely outside the bag and will not come in contact with the product being loaded or removed. A particular advantage to this type of construction for closing a plastic bag is the fact that the closure is literally part of the bag. It does not have to be added at a later time. Prior art closures have normally been horizontal closures which would go across the top of the bag and then hooked, enclosing the opening of the bag within the closure. These have closed and sealed satisfactorily but the fact that they must be separate from the bag or in some way difficult to attach to the bag, has made them less than desirable for closure purposes. Also, since the opening of the bag is within the closure, the closure must be adapted with a means by which to reopen the closure and bag. The snap closure of this invention obviates those problems and allows the user to seal the bag rather readily and quickly and effectively to carry any items of desire in the plastic bag with the opportunity of easily opening the snap closure to allow access to the bag. The ease of opening is accomplished as a result of having the mouth of the bag extend outward from the closed closure rather than being contained within the closure. To open the closure, the user need only grasp the exposed mouth of the bag and pull, thereby disengaging the closure.

Traditional recloseable profiles are affixed to both the inner front and back walls of the bag. The profiles are stiff members that make the bag difficult to open or receiving product. The bags tend to want to close such that the stiff profiles are in contact, but not placed together with enough force to seal. This can make it difficult to place a product in the bag because one hand is required to keep the bag opening open in such a way that the other hand can place the product into the bag.

The traditional recloseable profiles also require that each end of the profile sections be crimped by sonic welding, heat sealing, or any other mechanical means. The crimping of the ends aligns the profiles and reduces the thickness of the edges of the bag for cutting and sealing when manufactured. This crimping reduces the effective opening of the bag, resulting in a bag that is more difficult to open and load. The closure described in the present application is relatively flat, limber, and is only affixed to one side of the bag. Although it is crimped at the end, it is only crimped on one wall of the bag, and thus the crimping does not affect the opening of the bag to the same extent that the crimping of the traditional recloseable profiles does. The result is the bag of the present application opens easier and can be loaded faster.

The conventional profiles excluding those that include a slide, need to be aligned by the customer even though they are crimped for that purpose. The motion of aligning the profiles takes time and can be frustrating as the profiles do not always align correctly. It can also be difficult to determine whether the profiles are correctly engaged to effect a seal. It is not always apparent by merely looking at the closure. Some manufacturers have employed different colors on each of the profiles such that when they are placed together correctly, the color of the profiles appears different when the bag is correctly sealed. The closure of the present invention does not require alignment. The closure is automatically aligned when folded about its hinged section. This reduces a customers time and frustration level in closing the bag.

Reopening a bag using conventional profiles can also be difficult. The conventional profiles are opened by grasping the top of each bag wall with a separate hand, and pulling the walls apart to separate the profiles and open the bag. The closure of the present invention is easier to open. The user need only pull on the exposed mouth of the bag to open the closure. This can be accomplished with one hand or even with one's teeth.

Accordingly, it is an object of this invention to provide a snap closure for the mouth of a plastic bag which is attached to the bag itself and may easily be closed to seal the opening thereof. It is a further object of this invention to provide a closure for the mouth of the bag that is flexible and attached to only one wall of the bag. It is a further object of this invention to provide a closure for the mouth of the bag that will not become fouled by the product placed in or removed from the bag. It is further an object of this invention to provide a plastic bag with a closure that may be opened by pulling on the exposed top of the bag, without the need to separate the walls of the bag.

SUMMARY OF THE INVENTION

A one piece snap closure is provided for attachment to a plastic bag, more particularly, for example, a deli style bag. The one piece nature of the closure and its attachment to the bag is unique in that the closure does not have to be added to the bag after the items are put into it but is attached to the bag for easy use and because it is not on the inside of the bag, but snaps over the outside of the walls of the bag.

The snap closure is designed so that it can accommodate the thickness of the bag, i.e., the bag walls, and then clamp together with the bag walls between. The closure is only attached to one side of the bag opening, leaving the other side free so that the bag may be pulled widely open for items to be placed inside.

The snap closure also takes advantage of its placement on the bag, resulting in a double seal. The closure is placed a given distance from the opening or mouth of the bag, such that when closed, a portion of the unsealed side of the bag extends out beyond the closure. That is, the closure is attached and closed on the bag at an area between the mouth and bottom of the bag. The portion of a bag walls located between the attachment of the closure and the mouth of the bag is called a lip. Since both bag walls extend outward from the closed closure, a double thickness lip above the closed closure is formed.

In operation, the lips of the bag walls are folded at the hinge line of the closure. This fold is contained within the closure and as the closure is closed, the bag walls are pressed against each other forming a first seal. The action of a double lip being clamped in the mating surfaces of the closure forms a second seal. The placement of the closure also facilitates easy opening of the bag, without requiring any extended portions on the closure for opening the bag. The closure is placed on the bag sufficiently remote from the opening such that the double lip section is purposely made long enough that when the profile is closed a portion of the lip extends beyond the mating surfaces of the closure. This gives the customer an exposed bag surface to grasp and pull, which is absent on the bags of the prior art. This grasping and pulling of the lip easily separates the closures mating surfaces without the need for extended surfaces on the closure. The elimination of any extended surfaces on the closure allows for ease of manufacturing such that the product can be made in a continuous fashion without waste of either profile or bag material.

In addition, the one piece bag closure, with some modifications, can accommodate at its top a traditional zipper or other closure arrangements, results of which are a very conveniently closed plastic bag can be opened at the one piece bag closure or by other means such as the zipper mentioned above. The bags of the invention can be incorporated in to a saddle pack or a header pack for ease of dispensing in a commercial environment.

DESCRIPTION OF THE PREFERRED EMBODIMENT

Figure 1:
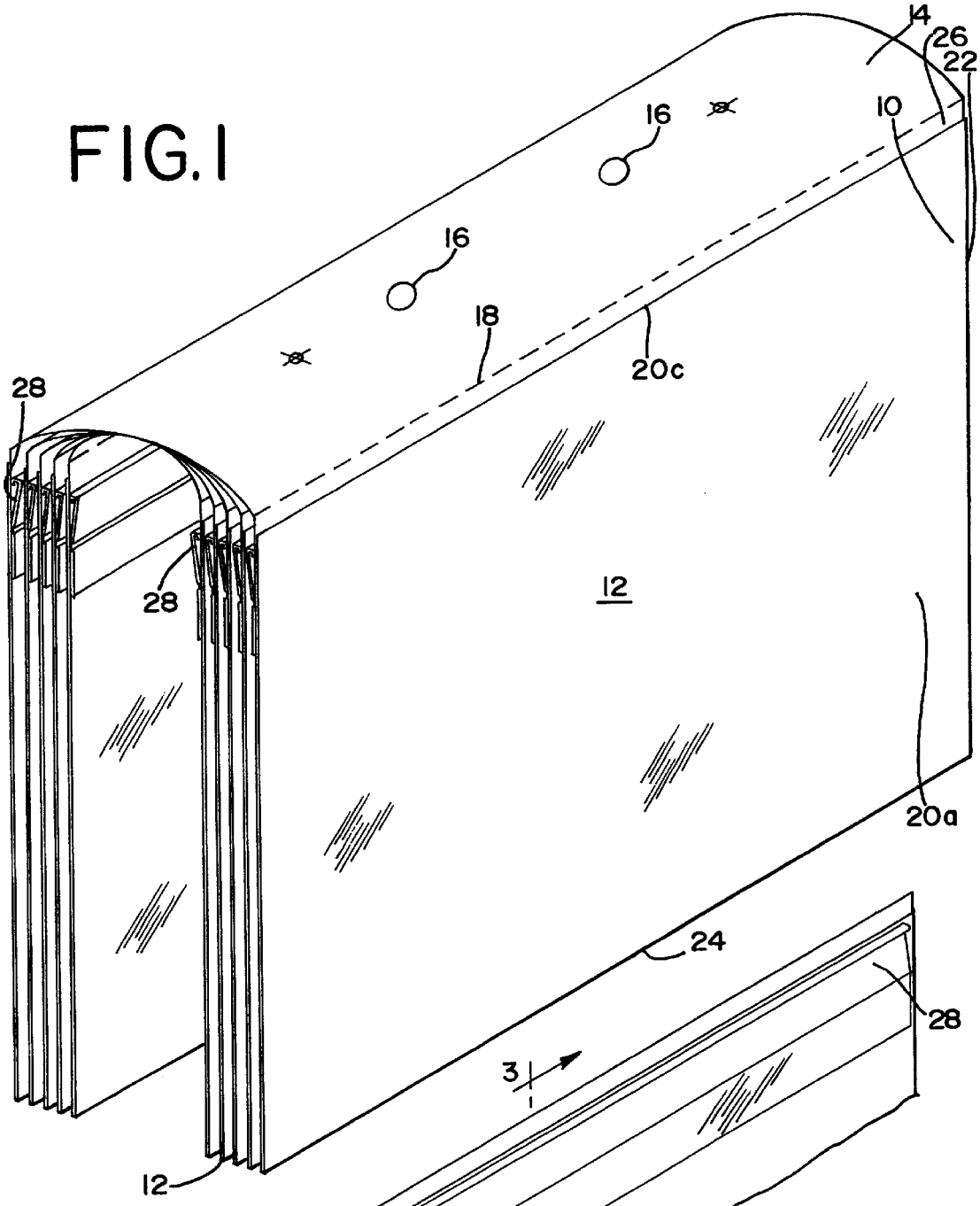
FIG. 1 is a perspective view of the plastic bags of this invention with the snap closure in place, the bags being in a saddle configuration.

Referring to FIG. 1 to give a general description of the plastic bag of this invention including the one piece snap closure, there is shown a bag saddle unit 10 which is one way that the plastic bags of this invention may be constructed. Additionally, the bags may be designed to be used with a header or the bags may be sold separately. The unit 10 includes a plurality of the bags 12 of this invention which are grouped together and attached to a saddle 14. The saddle includes holes 16 so that the saddle may be hung over a dispenser (not shown). Bags 12 are attached to the saddle 14 by a line of weakening 18 so that the bags may be removed from the saddle after they have been filled or before if it is desired.

The bags 12 themselves are of conventional construction having a front wall 20*a* and a rear wall 20*b*. The front wall 20*a* and rear wall 20*b* are joined together along the sides 22 and bottom 24 of the bag 12. The top 20*c* of the front wall 20*a* is not joined to the rear wall 20*b* and thus creates the opening 26 or mouth of the bag. It is through the mouth 26 that the bag is loaded and it may be loaded before the bag is removed from the saddle or the header as the case may be or the bag may be filled after it is removed.

Figure 2:
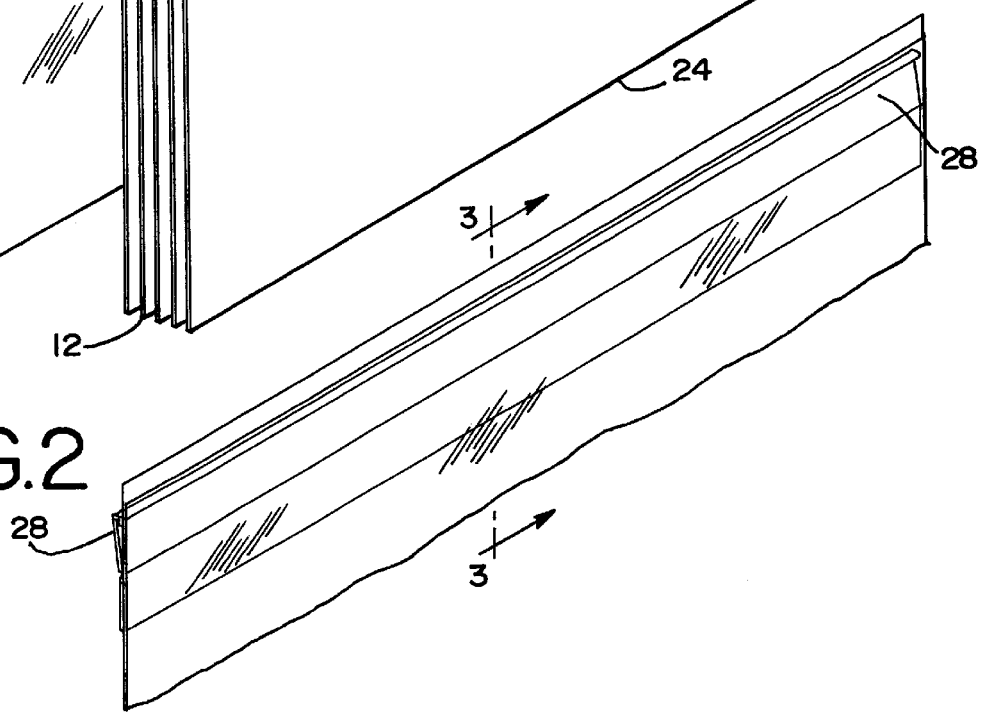
FIG. 2 is a perspective view, partially broken away, of the top of the plastic bags of this invention showing the one piece snap closure in phantom.
Figures 3, 4, 5, 6, 7:
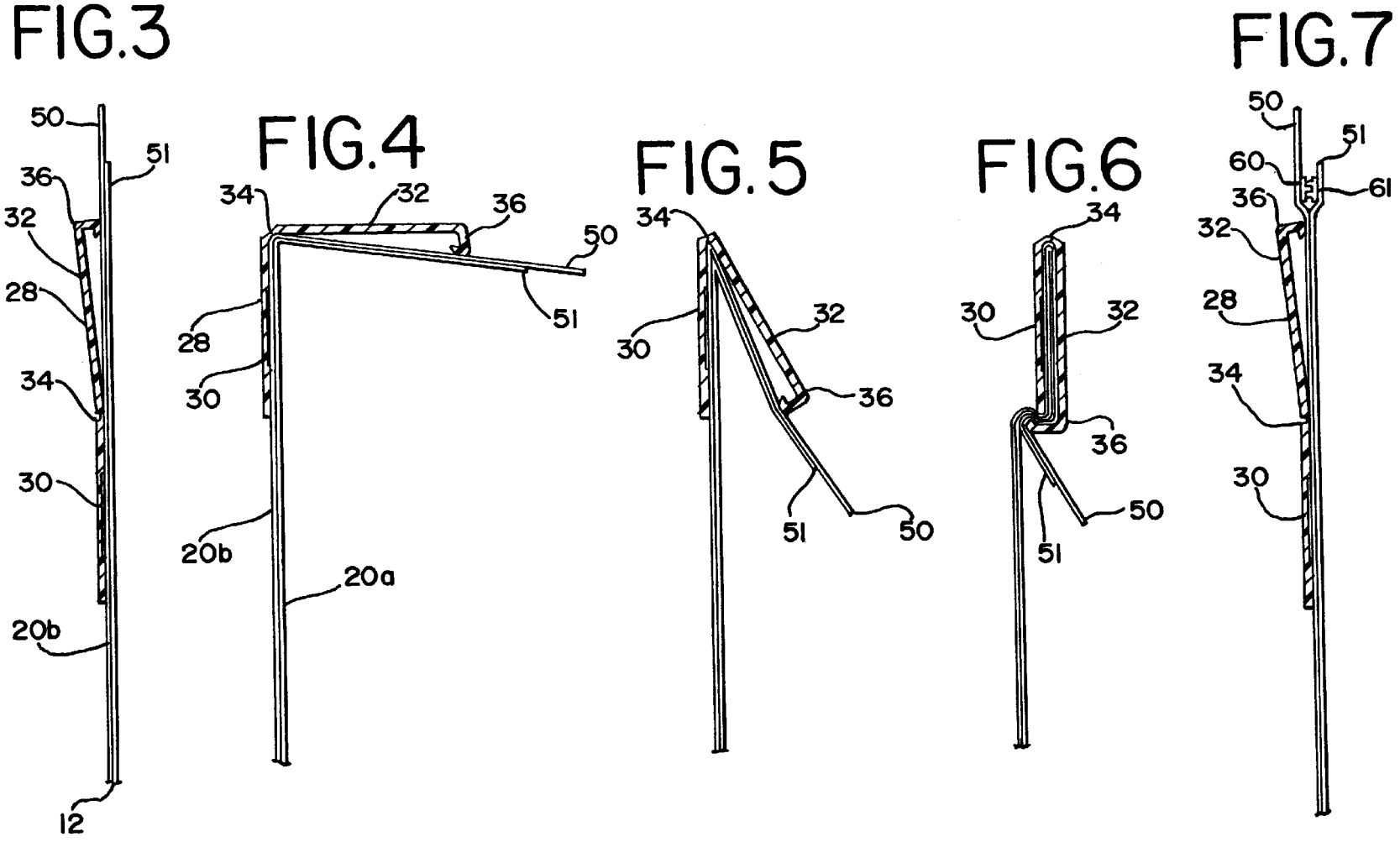
FIG. 3 is a sectional view taken along the line 3—3 of FIG. 2 and greatly enlarged to show the position of the one piece snap closure on the plastic bag of this invention.
FIGS. 4, 5 and 6 are sectional views similar to FIG. 3 but showing the gradual closing of the one piece snap closure of this invention.
FIG. 7 is a sectional view of a bag having zipper profiles and the one-piece snap closure.

Turning now to the snap closure 28, it can be seen in FIGS. 3 through 6 that the snap closure comprises a bottom portion 30 and an upper portion 32 which portions are hingedly connected together at 34. The lower or bottom portion 30 is attached to the rear wall 20*b* of the bag adjacent the upper end or the mouth 26 of the bag. The snap closure 28 extends across the top of the bag as can be seen in FIG. 2. As shown in FIG. 3, the snap closure 28 should be attached to the rear wall 20*b* sufficiently remote from the opening of the bag so that the upper portion 32 of the closure does not extend beyond the opening of the bag. With such placement, the opening 26 of the bag will extend outwardly from the snap closure 28 when the snap closure 28 is closed, as shown in FIG. 6. It is preferred that the snap closure 28 is located approximately ¾" from the mouth 26 of the bag, but this may vary depending upon the dimensions of the closure 28. The placement of the closure 28 must be sufficiently below the mouth 26 of the bag so that the lips 50 and 51 of the bag walls 20*a* and 20*b* extends outward from the closed closure 28. The attachment of the bottom portion 30 to the rear wall 20*b* can be by way of adhesive or heat sealing or any other method which will give a satisfactory attachment. The upper portion 32 of the snap closure terminates in a hook 36 which is designed to be hooked under the bottom portion 30 as will become apparent.

After the bag 12 is removed from the saddle 14 or header (not shown) it is in condition to be sealed, the product having been placed inside the bag. In order to close or seal the bag, the snap closure 28 through its upper portion 32 is rotated about the hinge at 34 toward the front wall 20*a* of the bag 12. This can be seen in FIGS. 3 through 6. The upper portion 32 is rotated around the hinge 34 downwardly carrying with it the top of the bag and the hook portion is then hooked under the bottom portion 30 of the snap closure as can be seen in FIG. 6. This effects a double seal. One seal at the hinge line where the bag walls are folded over, and another where the bag walls are crimped at the mating surfaces of the closure. This provides a very satisfactory seal for the bag so that items which could leak or ooze out of the bag are sealed in. Liquid materials may also be carried without leaking from the bag and yet the bag can readily be opened by simply pushing the hook portion 36 free from the bottom portion 30 of the snap closure to open the bag. The bag may also be opened by grasping an exposed lip 50 or 51 and pulling on it to disengage hook 36 from the bottom portion 30. After use the bag may again be sealed by swinging the upper portion 32 into position to lock the hook 36 over the bottom portion 30.

As an alternate embodiment, as shown in FIG. 7, interlocking zipper profiles 60 and 61 may be attached to the lips 50 and 51. The zipper profiles 60 and 61 are placed opposite each other, generally adjacent and coextensive with the top of each bag wall. In such a position, the profiles 60 and 61 may be opened and closed independently of the snap closure 28.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A plastic bag having a closure comprising:

a. a front wall;

b. a rear wall substantially congruent with said front wall and joined thereto along the sides and bottom thereby defining a chamber between said walls, said chamber having an opening;

c. a closure having an upper portion and a lower portion hingedly connected together, said upper portion terminating in a hook, said lower portion joined to one of said walls at a site of joinder, said bag walls each having a lip portion located between said opening and said site of joinder, at least one of said lip portions extending beyond the upper portion of said closure;

d. said closure being substantially parallel to said opening; and e. said closure folding over said bag walls when closed, said hook engaging said lower portion at a line of connection, thereby forming a first seal at the line of connection and a second seal within the closure.

2. The bag of claim 1 wherein the second seal forms where the lower portion and the upper portion are hingedly connected together.

3. The bag of claim 2 wherein the closure does not extend beyond the sides of the bag walls.

4. The bag of claim 1 wherein said closure device is made of a substantially rigid material.

5. The bag of claim 1 wherein said closure device is made of a plastic material.

6. The bag of claim 1, whereby the walls of the bag are secured between said hook and said lower portion when said upper portion is hooked under said lower portion.

7. The bag of claim 6, wherein the closure does not extend beyond the sides of the bag walls.

8. The bag of claim 6 wherein said closure device is made of substantially rigid material.

9. The bag of claim 6 wherein said closure device is made of a plastic material.

10. The bag of claim 6, wherein the closure does not extend beyond the sides of the bag walls.

11. A plastic bag having a closure comprising:

a) a front wall having two sides, a bottom, and a top;

b) a rear wall having two sides, a bottom, and a top;

c) said front wall and said rear wall being substantially congruent and joined together along the sides and bottom, thereby defining a chamber between said walls, said chamber having an opening at the top of said bag walls;

d) a closure having an upper portion and a lower portion, said lower portion joined to at least one of said walls at a site of joinder;

e) each of said walls having a lip portion, said lip portions being between said bag wall tops and said site of joinder and at least one of said lip portions extending beyond said upper portion;

f) said closure being substantially parallel to said opening; and g) said upper and lower portions hingedly attached to each other, and said upper portion terminating in a hook, said hook being adapted to be hooked under the lower portion when the closure is closed, thereby forming a first seal at the hook and a second seal within the closure.

12. The bag of claim 11, including interlocking profiles on each of said bag walls.

13. The bag of claim 12, wherein the interlocking profiles are coextensive with the opening of said bag, and located adjacent the tops of the bag walls.

14. The bag of claim 11 wherein a second seal of the bag opening forms upon closing the closure, said second seal forming where the upper and lower portions of the closure are hingedly connected.

* * * * *